United States Patent [19]

Carroll

[11] 4,004,056

[45] Jan. 18, 1977

[54] POROUS LAMINATED SHEET

[75] Inventor: Charles D. Carroll, Greensburg, Ind.

[73] Assignee: General Motors Corporation, Detroit, Mich.

[22] Filed: July 24, 1975

[21] Appl. No.: 598,963

[52] U.S. Cl. ..... 428/138; 60/39.66; 416/231 R; 431/352; 431/353; 29/191.4

[51] Int. Cl.[2] ..... B32B 3/10; F23D 15/02

[58] Field of Search ..... 29/156.8 B, 182.3, 191, 29/191.4, 194; 161/112; 416/229, 231; 60/39.66, 265; 431/351–353; 428/137, 138, 163, 164

[56] References Cited

UNITED STATES PATENTS

| | | | |
|---|---|---|---|
| 3,584,972 | 6/1971 | Bratkovich et al. | 416/231 |
| 3,606,572 | 9/1971 | Schwedland | 416/231 |
| 3,606,573 | 9/1971 | Emmerson et al. | 416/231 |
| 3,620,643 | 11/1971 | Jones | 416/231 |
| 3,672,787 | 6/1972 | Thorstenson | 416/231 |
| 3,719,365 | 3/1973 | Emmerson et al. | 416/231 |
| 3,732,031 | 5/1973 | Bowling et al. | 416/231 |
| 3,864,199 | 2/1975 | Meginnis | 416/231 |
| 3,925,983 | 12/1975 | LaBotz | 60/265 |

*Primary Examiner*—Carlton R. Croyle
*Assistant Examiner*—Robert E. Garrett
*Attorney, Agent, or Firm*—Paul Fitzpatrick

[57] ABSTRACT

A porous laminated sheet adapted to be cooled by air flowing through the sheet from a rear face to a front face and to discharge the air through outlets in the front face at an angle to the normal to the surface. It is particularly adapted for use as a wall of a combustion liner. The sheet has a front layer with grooves leading to outlets from the front layer and has a rear layer defining channels from the exposed face of the rear layer into the grooves.

2 Claims, 7 Drawing Figures

POROUS LAMINATED SHEET

My invention is directed to a configuration of porous laminated metal sheet and to heat resisting components made from such a sheet.

Considerable talent and effort has been put into the development of sheet materials of controlled porosity adapted for convection cooling by air flowing through the pores in the sheet and for film cooling by the air discharged from the heated face of the sheet. Such materials are currently made by etching metallic sheets to obtain the desired pattern of holes and grooves in the sheets and then bonding the sheets together to form the laminated porous material. Examples of this are disclosed in Bratkovich et al. U.S. Pat. No. 3,584,972, June 15, 1971, and Meginnis U.S. Pat. No. 3,698,834, Oct. 17, 1972. The principal application of such laminated material has been to air-cooled turbine vanes and blades, but their use in other hot components of gas turbine engines such as combustion liners has been proposed in the Bratkovich et al. patent.

My invention is directed to the provision of a laminated porous sheet material of superior characteristics, particularly one which may be fabricated from only two laminae and is adapted to the use of rather thick sheets of sufficient strength for self-supported structures of considerable size as, for example, combustion liners of gas turbine combustion apparatus. The preferred structures according to my invention are characterized by a high degree of cooling and by a simple pattern of the holes and grooves in the sheets which are readily produced by etching the sheets. It is also characterized by oblique discharge of the cooling air from the hot face of the sheet. By oblique discharge I mean discharge that is at a substantial angle to the perpendicular or normal direction to the face of the sheet.

In one form of porous material according to my invention, the discharge is characterized by jets oriented in opposite directions over the face of the sheet so as to set up controlled small scale turbulence in the discharged layer of air. In another form, the discharge is all in the same direction so that a more nearly laminar layer of discharged air is produced.

The principal objects of my invention are to provide an improved readily fabricated porous sheet material of controlled porosity and of superior discharge pattern. A further object is to provide a laminated porous material adapted to be fabricated from relatively heavy gauge layers. A further object is to provide a laminated porous material having a high degree of control over the pattern of discharge of the air from the sheet and highly effective use of cooling air. A further object is to provide such a material of good formability.

The nature of my invention and its advantages will be clear to those skilled in the art from the succeeding detailed description of preferred embodiments of the invention, including a combustion liner fabricated from a porous sheet metal according to my invention.

Referring to the drawings, FIG. 1 is a longitudinal sectional view of a gas turbine combustion liner.

Figure 1:
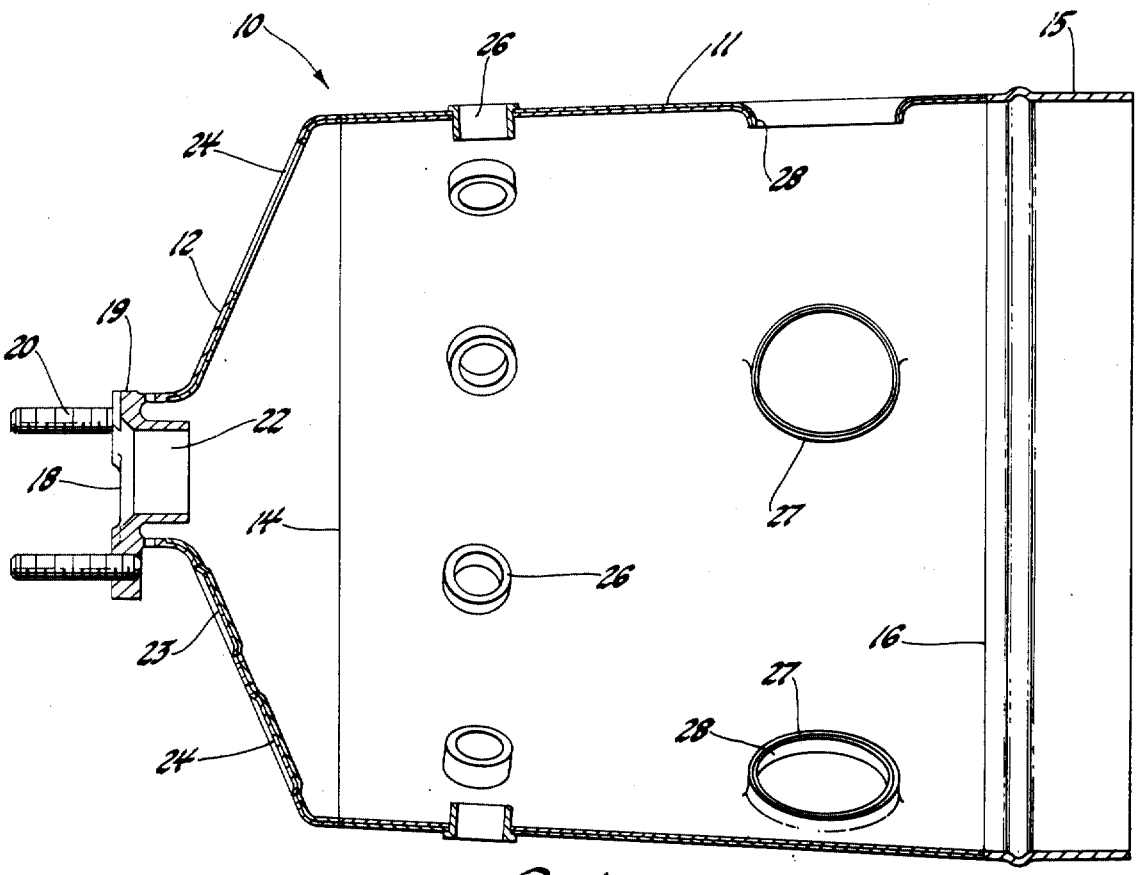

FIG. 1 illustrates a combustion liner, otherwise known as a flame tube, for a gas turbine engine. For example, such a liner might be used in the engine of Collman et al U.S. Pat. No. 3,267,674 issued Aug. 23, 1966, or the engine illustrated in Bell U.S. Pat. No. 3,490,746, Jan. 20, 1970. The use of such liners is well known and there is no need to describe the structure with which it is employed.

The particular liner 10 illustrated in FIG. 1 is defined principally by a slightly tapering side wall 11 of circular cross section and a dome or head end wall 12. These are formed from porous sheet metal according to my invention, as will be described. They are butt-welded together along the junction line 14. The liner also includes an outlet ring 15 of non-porous high temperature resisting sheet metal butt-welded to the side wall 11 along the line 16. A fitting 18 is welded over an opening at the center of the dome. This fitting includes a flange 19 which may bear against the cover of the combustion chamber and studs 20 by which the flange is held in place against the cover. The fitting defines an opening 22 for a fuel spray nozzle (not illustrated). It also provides an access opening (not illustrated) for an igniter to initiate combustion. The dome is slotted and formed to define inner and outer rows of air-swirling louvers 23 and 24, respectively. A ring of primary or combustion air inlet openings are provided by sleeves 26 extending inwardly from the liner wall 11 and welded or brazed to it. Secondary or dilution air is admitted through a ring of large ports 27 which are provided by punching and forming the wall 11 so as to provide a wall 28 bounding the port and projecting slightly into the liner.

As is well known, in the operation of such a device, the air admitted through the louvers and the air admitted through the sleeves 26 combines with the fuel and the resulting products of combustion are diluted by air coming through the ports 27 to bring the motive fluid temperature down to a suitable level for operation of the gas turbine. Since combustion is very intense in such devices, the liner walls 11 and 12 are subjected to very intense radiation and need to be cooled.

Conventionally, combustion liner walls have been cooled by films of air flowing over the interior surface of the wall; and also it has been proposed to cool by air flowing through walls of a porous nature. It has also been proposed to flow air over the outer surface or within a double wall of such a liner in such way as to achieve efficient convection cooling.

According to my invention, the wall is porous so that air flows through the wall to many small outlets from many air entrances. The air is led through the liner wall in tortuous paths so as to achieve a very high degree of efficiency of heat transfer from the wall to the cooling air. Also, the cooling air is discharged from the inner surface of the liner at an acute angle to the wall so as to provide a shielding film of air between the wall and the reacting fuel and combustion air within the liner.

Figure 2:
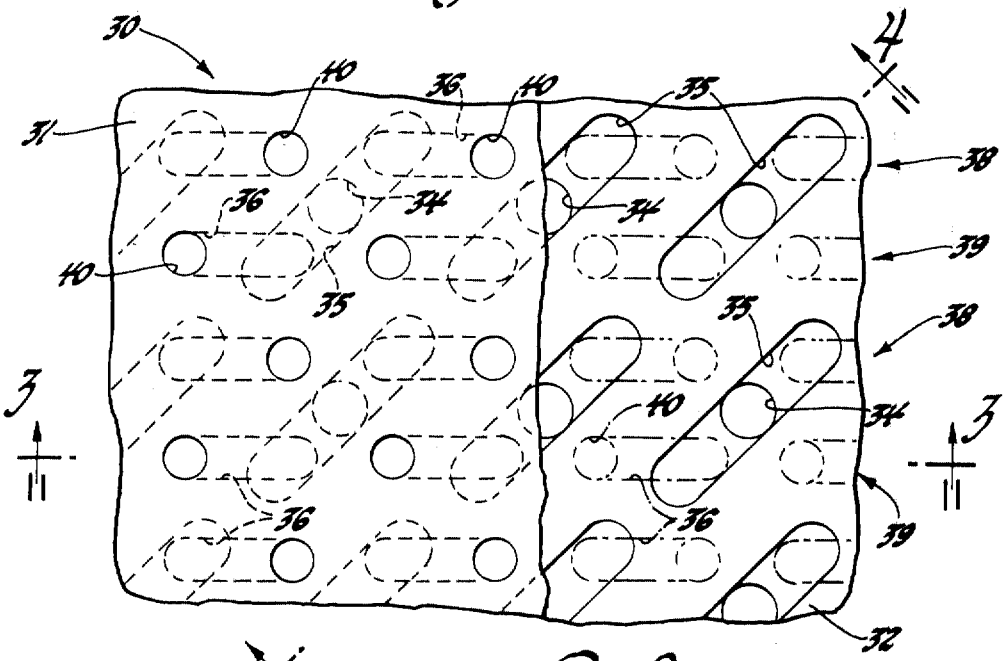
FIG. 2 is a greatly enlarged view of a porous laminated sheet of a first type, with parts cut away.
Figure 3:
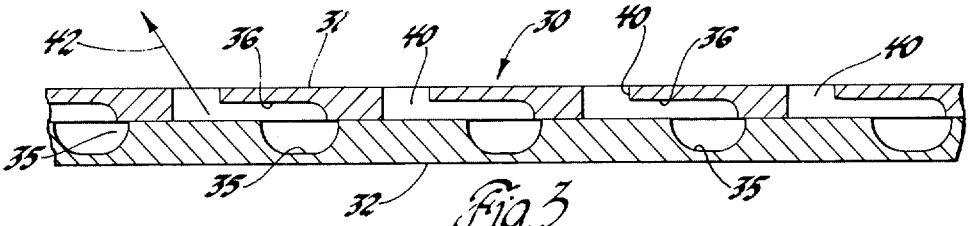
FIG. 3 is transverse sectional view taken on the plane indicated by the line 3—3 in FIG. 2.
Figure 4:
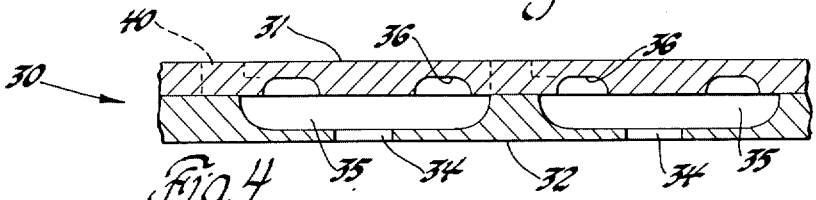
FIG. 4 is transverse sectional view taken on the plane indicated by the line 4—4 in FIG. 2.

In the presently preferred embodiment of the invention, this is accomplished by the use of a sheet material of the form illustrated in FIGS. 2 through 4 of the drawings. These figures show the laminated material from which the liner wall is formed on a greatly enlarged scale. Specifically, the drawings are a 10 to 1 enlargement of the particular configuration of the laminated sheet.

The sheet 30 of FIGS. 2, 3, and 4 is made up of a front layer 31 and a rear layer 32, the sheet being viewed from the direction of the front layer in FIG. 2 with a portion of the front layer cut away to expose the rear layer. The front layer is the layer which is on the inside of the combustion liner in FIG. 1 and is the one exposed to the intense heat of combustion. The rear layer is exposed to air in the combustion apparatus at a slightly higher pressure than the pressure inside the liner so that the cooling air can flow through the porous structure of the sheet 30. The outer exposed surface of the rear layer 32 has a large number of apertures 34 arranged in a generally rectangular pattern, each aperture 34 leading into the middle of a slot 35 in the inner face of the layer. The slots 35 provide a channel for flow of air from the apertures 34 into the front layer 31. The long axis of the slots 35 is disposed in the direction of the diagonal across one of the squares defined by four adjacent apertures 34. The front layer 31 is formed to provide a rectangular pattern of short grooves 36 in its inner face; that is, the face abutting layer 32. The grooves 36 may be considered to be in alternating rows 38 and 39. As viewed in FIG. 2, the left-hand end of each groove 36 in the rows 38 overlies a slot 35 to define an inlet for air from the slot 35 into the groove 36. The grooves in the alternating rows 39 have the inlet at the right-hand end of the groove as viewed in FIG. 2. Thus air entering through any aperture 34 flows in two directions through the slot 35 and into a groove 36 in each of two adjoining oppositely directed rows of grooves. Each groove terminates at the end opposite its inlet at an outlet hole 40 from which the cooling air is delivered through the hot or front face of the sheet 30. Since the air flows through the groove 36 with considerable velocity, it retains much of this component of velocity in the direction parallel to the face of the sheet 30 as it is discharged through the outlet holes 40 more or less as indicated by the arrow 42 in FIG. 3. Obviously, the air delivered from the outlet holes 40 of rows 39 will be delivered with a component of motion to the left as viewed in FIG. 2 or FIG. 3 whereas that from rows 38 will be delivered in the opposite direction; that is, toward the right as viewed in FIG. 2 or FIG. 3.

As is clearly apparent from FIG. 2, the pattern of slots and grooves closely covers the entire area of the sheet with rather small spaces between adjacent slots or grooves. There is thus uniform cooling of the material. The degree of cooling can, of course, be adjusted by varying the cross sectional area of slots 35 or grooves 36 or the pattern of distribution of the slots and grooves. Also, the amount of air flow can be controlled by dimensioning the apertures 34 or holes 40 to suit. The slots, grooves, apertures, and holes may be conveniently formed in the layers by photoetching, and the layers may be diffusion bonded together generally as described in the Bratkovich et al. patent referred to above.

To give an idea of scale in the particular structure just described, the front layer 31 is about 0.5 millimeters thick and the rear layer about 0.8 millimeters. Apertures 34 are approximately 0.9 millimeters in diameter, which is the width of the slots 35, the slots being approximately 0.6 millimeters deep. The grooves 36 are approximately 0.35 millimeters deep by 0.75 wide. There are approximately 16 outlet holes per square centimeter.

As will be apparent, with the air jets from the slots 38 directed generally to the right and those from row 39 directed generally to the left, there will be a shear between the alternate sheets or sets of jets of air from the alternate rows which will set up small scale turbulence in the form of vortices adjacent the surface of the sheet 30. This should enhance the cooling effect and minimize possible deposition of particulate matter on the surface of the liner. Air so admitted may enter into the combustion process to some extent but ordinarily could be expected to remain near the wall and be mixed ultimately with the combustion products in the general turbulence caused by the entry of jets of air from the sleeves 26 and ports 28. Because of the very small size of the jets from the small outlet holes 40 there should be no considerable penetration of this cooling air into the body of air in the interior of the combustion liner.

Figure 5:
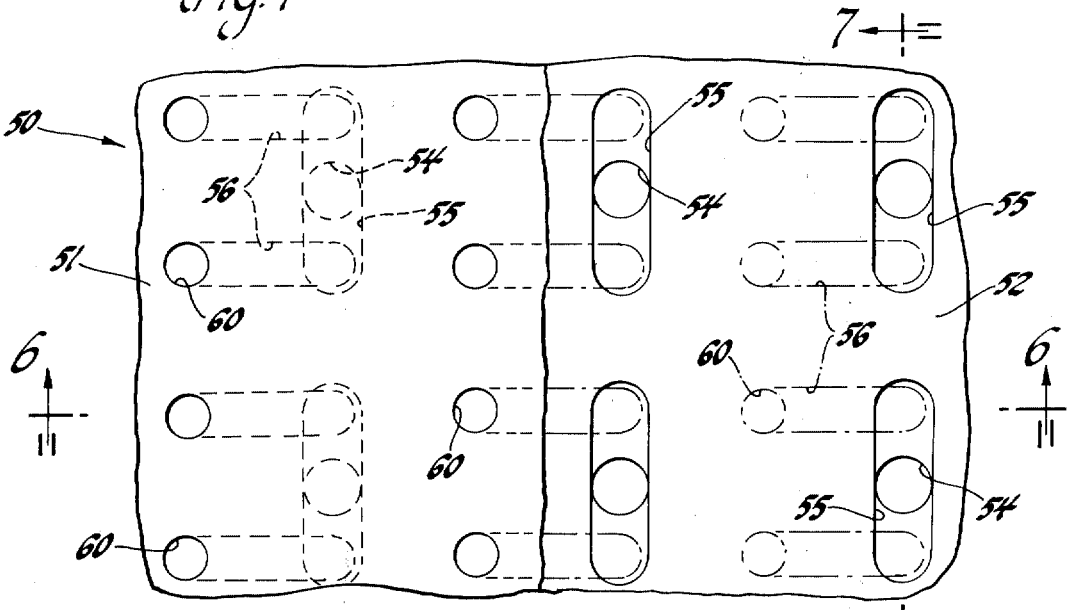
FIG. 5 is a greatly enlarged view of a second form of porous sheet, with parts cut away.
Figure 6:
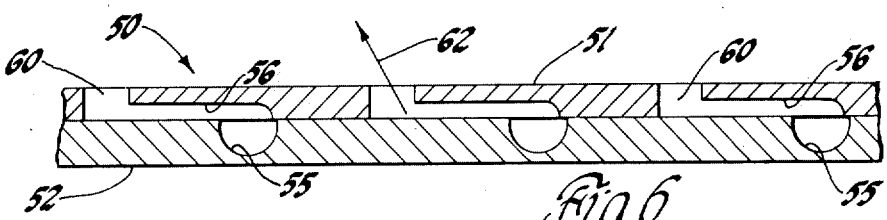
FIG. 6 is a sectional view taken on the plane indicated by the line 6—6 in FIG. 5.
Figure 7:
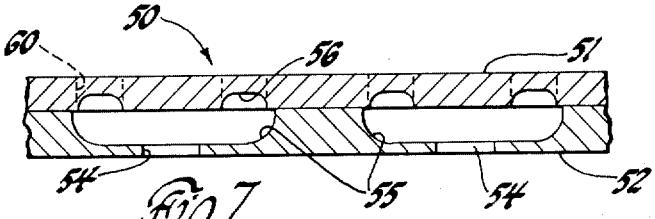
FIG. 7 is a sectional view taken on the plane indicated by the line 7—7 in FIG. 5.

The principles of my invention are also applicable to a sheet in which all of the air is discharged with the component in the same direction parallel to the surface of the sheet where such an arrangement is considered desirable. One embodiment of a sheet having this characteristic is illustrated in FIGS. 5, 6, and 7. In this case, the sheet 50 has a front layer 51 and a rear layer 52, the front layer being shown partly cut away in FIG. 5. The rear layer has apertures 54 distributed in a rectangular pattern leading into the middle of slots 55. The ends of slots 55 communicate with one end of grooves 56 in the inner face of sheet 51. Each groove 56 leads from slot 55 to an outlet hole 60. In this case the apertures 54 and outlet holes 60 are laid in a generally rectangular pattern, but the direction of flow in all of the grooves 56 is the same. In this case, all of the air will be delivered with a component of motion to the left as illustrated in FIG. 5 and as indicated by the arrow 62 in FIG. 6. Such a pattern might be desirable for various purposes. In a combustion liner the direction of flow of the air could have an upstream component, a downstream component, or a circumferential component, or a mixture of upstream or downstream with circumferential, and this would have some influence on the flow of air in the liner. A certain amount of swirl of air could be engendered if desired. Also, the form illustrated in FIGS. 5 through 7 might find employment in a device such as a turbine vane or blade where it would be desirable to have the component of flow of the cooling air go along with the gas flowing past the vane or blade.

The dimensional characteristics of the sheet as illustrated in FIGS. 5 through 7 may be much as described in connection with FIGS. 2 through 4. The thickness of the sheets and the size of the various openings and passages can be changed to suit the needs of a particular installation. When bonded, the sheet has good formability to be formed into structures such as those illustrated in FIG. 1, and can be thick enough to be quite rigid.

It will be seen that my invention provides a very simple readily fabricated structure of good strength characteristics and high efficiency of cooling by air flowing through the sheet, and it is very suitable for such articles as combustion liners or other structures in a hot gas stream or exposed to intensive heat radiation and therefore needing to be cooled.

The detailed description of the preferred embodiment of the invention for the purpose of explaining the principles thereof is not to be considered as limiting or restricting the invention, since many modifications may be made by the exercise of skill in the art.

I claim:

1. A laminated porous metal sheet adapted for convection cooling of the sheet by gas flow through the sheet and to provide a shielding turbulent gas flow over a front face of the sheet exposed to a source of heat, the sheet comprising a front layer and a rear layer, the two said layers being in abutting face-to-face relation and being bonded together; the front layer having an outer face constituting the front face of the sheet and an inner face abutting the rear layer, having a multiplicity of rows of separate, short grooves in the inner face with the rows extending generally parallel and with the grooves elongated in the direction of the rows, adjacent groups of four grooves being arranged in a rectangular pattern, each groove in said pattern having an inlet into one end of each groove and an outlet hole extending from the other end of each groove through the outer face; the rear layer having an outer face constituting the rear face of the sheet and an inner face abutting the front layer and having a multiplicity of slots in the inner face, one of said slots communicating with two said inlets disposed in grooves of each of said rectangular pattern and others of said slots communicating with inlets of the remaining grooves in said rectangular pattern and with inlets of grooves formed in adjacent ones of said rectangular patterns to spread coolant flow between said front and rear layers; and the rear layer defining an aperture leading from its outer face into each said slot; so that gas flowing through the sheet from the rear face to the front face is fed through the said apertures, slots, inlets, grooves, and outlet holes, and is discharged from the outlet holes of adjacent rows with substantial inclination to a normal to the front face of the sheet.

2. A laminated porous metal sheet adapted for convection cooling of the sheet by gas flow through the sheet and to provide a shielding turbulent gas flow over a front face of the sheet exposed to a source of heat, the sheet comprising a front layer and a rear layer, the two said layers being in abutting face-to-face relation and being bonded together; the front layer having an outer face constituting the front face of the sheet and an inner face abutting the rear layer, having a multiplicity of rows of separate short grooves in the inner face with the rows extending generally parallel and with the grooves elongated in the direction of the rows, and each of said separate grooves having an inlet into one end of each groove and an outlet hole extending from the other end of each groove through the outer face, said front layer being formed to block flow between inlet and outlet holes of adjacent separate grooves therein, said inlets and outlet holes in alternate rows disposed so that the direction of flow through the grooves from inlets to outlet holes in adjacent rows is opposite; the rear layer having an outer face constituting the rear face of the sheet and an inner face abutting the front layer and having a multiplicity of slots in the inner face, each said slot communicating with two said inlets disposed in adjacent rows; and the rear layer defining a aperture leading from its outer face into each said slot; so that gas flowing through the sheet from the rear face to the front face is fed through the said apertures, slots, inlets, grooves, and outlet holes, and is discharged from the outlet holes of adjacent rows with opposite direction of substantial inclination to a normal to the front face of the sheet.

* * * * *